US007121221B2

(12) United States Patent
Lawrence

(10) Patent No.: US 7,121,221 B2
(45) Date of Patent: Oct. 17, 2006

(54) FLOATABLE DOCK MOORING ARTICLE

(76) Inventor: Gary L. Lawrence, 8036 Bricker Rd. NW., Massillon, OH (US) 44646

( * ) Notice: Subject to any disclaimer, the term of this patent is extended or adjusted under 35 U.S.C. 154(b) by 0 days.

(21) Appl. No.: 11/391,044

(22) Filed: Mar. 28, 2006

(65) Prior Publication Data

US 2006/0162636 A1 Jul. 27, 2006

Related U.S. Application Data

(63) Continuation-in-part of application No. 10/953,154, filed on Sep. 29, 2004, now Pat. No. 7,021,230.

(51) Int. Cl.
*B63B 22/02* (2006.01)
*B63B 21/00* (2006.01)

(52) U.S. Cl. ..... 114/230.13; 114/230.27

(58) Field of Classification Search ..... 114/230.1, 114/230.11–230.18, 230.27, 230.28
See application file for complete search history.

(56) References Cited

U.S. PATENT DOCUMENTS 3,001,371 A 9/1961 Gilmore, Jr. et al.
3,430,598 A 3/1969 Soderberg
3,486,342 A 12/1969 Aks
RE27,050 E 2/1971 Jorgenson
3,842,779 A 10/1974 Jaynes
4,480,576 A 11/1984 Mills
5,050,521 A 9/1991 Stone
5,301,628 A 4/1994 Daskalides
5,467,727 A 11/1995 Godvin et al.
5,937,781 A 8/1999 Isella et al.
6,123,045 A 9/2000 Prongay

*Primary Examiner*—Jesús D. Sotelo
(74) *Attorney, Agent, or Firm*—Hudak, Shunk & Farine Co. LPA

(57) ABSTRACT

A floating dock mooring article that is movably connected around a watercraft dock pipe comprises a float operatively connected to a mooring member having a flange generally located at the upper end thereof. A watercraft is moored to the dock, as by a rope, via the mooring article. The mooring member has at least one radially outward set projection having an external diameter and the float has at least one radially inward projection having an internal diameter. The mooring member projection external diameter is greater than the float inward projection internal diameter. The inward projection is capable of engaging the mooring member projection so that the float is set at a predetermined height of said mooring member and/or the float is capable of causing the mooring member to rise.

26 Claims, 4 Drawing Sheets

FLOATABLE DOCK MOORING ARTICLE

CROSS REFERENCE TO RELATED APPLICATION

This application is a continuation-in-part of related application Ser. No. 10/953,154 filed Sep. 29, 2004, now U.S. pat. No. 7,021,230 issued Apr. 4, 2006.

FIELD OF THE INVENTION

The present invention relates to a floatable dock mooring article that can rise and fall with a water level. More specifically, the article relates to a mooring member which is movably connected to a portion of a dock pipe, and generally has a radially outward set projection which is capable of engaging a radially inward projection of a float so as to either locate the float at a predetermined location along the vertical height of the mooring member, or to permit the float to rise with the water level and upon engaging the outward set projection to cause the mooring member to rise along the dock pipe.

BACKGROUND OF THE INVENTION

Heretofore, watercrafts such as boats, canoes, jet skis, rafts etc. have generally been moored to a dock pipe as by a rope. If tightly bound, the rope would prevent the watercraft from rising as the water level rises, thus causing the watercraft to tip and possibly sink. Alternatively, if the rope was loosely bound, the rope would rise with increasing water height and come off the dock pipe causing the watercraft to drift away and even be lost.

Prior art mooring devices are set forth in the following U.S. patents:

U.S. Pat. No. Re 27,050 relates to a reportedly force absorbing system adapted to be used with a moored vessel including a base affixed to the dock, a pair of yielding elements extending from the base and a pair of vertically disposed bumper sections attached to respective yielding elements. The bumper sections are suspended in the water with clearance from the bottom and receive support from the dock from above the water line.

U.S. Pat. No. 3,001,371 relates to an offshore drilling rig mooring and more particularly to a floating mooring buoy especially adapted for a floating attachment to an offshore drilling rig support.

U.S. Pat. No. 3,430,598 relates to a mooring device for mooring a boat having an upright pair of shafts adapted to be inserted upright into the lake bottom in spaced parallel relation to one another, with the upper portions of the shafts projecting above the surface of the lake, a pair of air tight containers acting as floats, said containers each having a vertical bore to slideably receive the said shafts, rope attaching means on each of said containers, said shafts being spaced further apart from one another than the length of said boat, rope means attached to the front of the boat may be attached to one of said containers and the rope means attached to the rear of said boat may be attached to the other of said containers, and said container will reportedly float upward and downward on said shaft in response to changes to the lake surface while maintaining said boat moored between said shaft.

U.S. Pat. No. 3,486,342 relates to a mooring bumper device having a floatable base floating on a water surface and loosely surrounding a mooring pile for up and down movement thereon under the action of tide and wind. The bumper device has an axial opening through which the mooring pile extends and the upper terminal end of the bumper device is flat and horizontal. A metal hitch ring provided with a plurality of eyes to one or more of which a boat mooring line is attached is freely seated on the flat upper end of the bumper device in surrounding relation to the mooring pile providing relative rotation between the bumper device and the hitch ring. The eyes on the hitch ring lie inwardly of the peripheral edge of the flat upper end of the bumper device.

U.S. Pat. No. 3,842,779 relates to a boat mooring device comprising a bow-shaped frame member with a cable or the like attached thereto and with a slidable member supported on said cable and secured to a boat so that as the movement of the water causes the boat to move up and down, as well as in other directions, the sides of the boat will bear against the slidable member and reportedly will move it to correspond to the up and down movement of the boat and thereby prevent scuffing and damage to the boat.

U.S. Pat. No. 4,480,576 relates to a boat mooring arrangement which reportedly permits the boat to rise and drop vertically with tides or wave action, but which constrains the boat from lateral movement relative to a fixed dock or pier. A pair of cylindrical posts are affixed to the dock or pier at spaced-apart locations and extend vertically downward therefrom for a predetermined distance below the surface of the water. Associated with each of these posts is a carriage assembly comprising a U-shaped collar having rollers journaled for rotation across the spaced-apart legs of the U-shaped collar. The carriage assemblies reportedly cooperate with the exterior surface of the posts and ride up and down with respect to the posts when the carriage assemblies are fastened to the boat to be moored by suitable tie lines and changes in water level are encountered.

U.S. Pat. No. 5,050,521 relates to a boat mooring apparatus to allow for ease of travel up and down dock piling posts in such a fashion that it is free to move vertically with changes in tide. It comprises a mooring line roller and chafe resistor which includes a ribbed tube and spools or rollers mounted on tube and fitted over the mooring lines. It is fitted on the dock lines and around the dock posts and tied to the cleats of a vessel to be moored.

U.S. Pat. No. 5,301,628 relates to a docking post which includes a tubular housing having a front wall, including an elongate slot directed through the front wall longitudinally aligned relative the housing and parallel to the housing axis, with the housing having a rear wall mounted to an associated mooring post. A first tube is mounted within the housing, having a securement ring thereon, with a second tube positioned below the first tube having a length adjusted to accommodate a predetermined length between a boat water line and a boat securement cleat. A third buoyant tube is mounted below the second tube to effect displacement of the first and second tube to reportedly effect displacement of the first and second tube relative to rising and lowering tides and water level relative to the tubular housing.

U.S. Pat. No. 5,467,727 relates to a hollow toroidal member of high-strength material for reportedly withstanding mooring loads and has a central opening which slips over a mooring pile. A reinforcing ring is preferably secured in the core of the member to provide additional load-bearing capability to the device. A pair of diametrically opposite mooring openings are formed in the member and ring each opening for receiving a boat mooring line, the openings in the member and ring being aligned. The member is preferably molded with its core in fluid isolation from the ambient atmosphere to provide buoyancy. In the alternative, the core is filled with flotation material. A pair of apertured legs may be used in place of the openings in the member for securing the mooring lines thereto.

U.S. Pat. No. 5,937,781 relates to a watercraft mooring device which reportedly permits the watercraft to rise and drop vertically with the water level and which provides both direct shock absorption between the watercraft and the fixed mooring point, such as the pier or piling, and protection against scraping between the watercraft and the fixed mooring point. A floating tube is provided, which is designed to loosely fit over and around the fixed mooring point and which provides one or more attachment grooves for holding an attachment rope, cord or cable in place. The provided floating tube includes one or more securing hooks for securing the attachment rope, cord or cable when it is not needed to moor the watercraft. By providing a floating mooring device, the watercraft is permitted to maintain the same relative distance between the watercraft and the fixed mooring point, providing a device for protecting a watercraft from undesirable contact with other mooring structures.

U.S. Pat. No. 6,123,045 relates to a device for dock storage and boat accessible retrieval of a boat docking line. The device generally comprises a pedestal that is fixedly attachable to a dock and an arm rotatably attached to the upper end of said pedestal, said arm including a hook disposed at the distal end of said arm for receipt of a docking line.

SUMMARY OF THE INVENTION

A dock mooring member that slidably fits around a dock pipe rises and falls with the level of the water thus allowing a watercraft such as a boat to rise and fall with the water level and not tip, sink or be released from the dock. A floatable dock mooring article comprising the mooring member generally has a flange at the upper portion thereof and a floatation device located beneath the flange.

The mooring member generally has at least one radially outward set projection and the floatation device that desirably is a float has a radially inward projection with the mooring member set projection and the float inward projection being capable of engaging each other so as to either act as a set location along the mooring member to prevent the float from settling or, alternatively, to keep the float from rising above the set projection so that upon further rising of the water level, the float will cause the mooring member to rise along the dock pipe.

In one aspect of the present invention a floatable dock mooring article is described, comprising a mooring member having at least one radially outward set projection, said at least one radially outward set projection having an external diameter; said mooring member adapted to have an internal diameter greater than the outer diameter of a dock pipe and being capable of contacting and resting on a portion of a dock, said mooring member adapted to be movably connected to a portion of said dock pipe; a flange, said flange located at the top portion of said mooring member; an optional float retention flange located below said mooring member flange and above said mooring member outward set projection; and a float operatively connected to said mooring member, said float having at least one radially inward projection having an internal diameter, said mooring member projection external diameter being greater than said float inward projection internal diameter, and said mooring member set projection being capable of engaging said float inward projection.

In a further aspect of the present invention a floatable dock mooring article is described, comprising a mooring member having a) radially outward set projection or b) a radially inward recess, or both said a) and said b), said at least one radially outward set projection having an external diameter, said radially inward recess having an internal diameter, said mooring member adapted to have a minimum internal diameter greater than the outer diameter of a dock pipe and being capable of contacting and resting on a portion of a dock, said mooring member adapted to be movably connected to a portion of said dock pipe; a flange, said flange located at the top portion of said mooring member; an optional float retention flange located below said mooring member flange and above said mooring member outward set projection; and a float operatively connected to said mooring member, said float having at least one radially inward projection having an internal diameter, wherein when present said mooring member radially outward set projection external diameter is greater than said float inward projection internal diameter, and said mooring member radially outward set projection being capable of engaging said float inward projection, and wherein the float radially inward projection engages said mooring member radially inward recess when present so that upon upward movement of said float, said mooring member is moved therewith.

DETAILED DESCRIPTION

Figure 1:
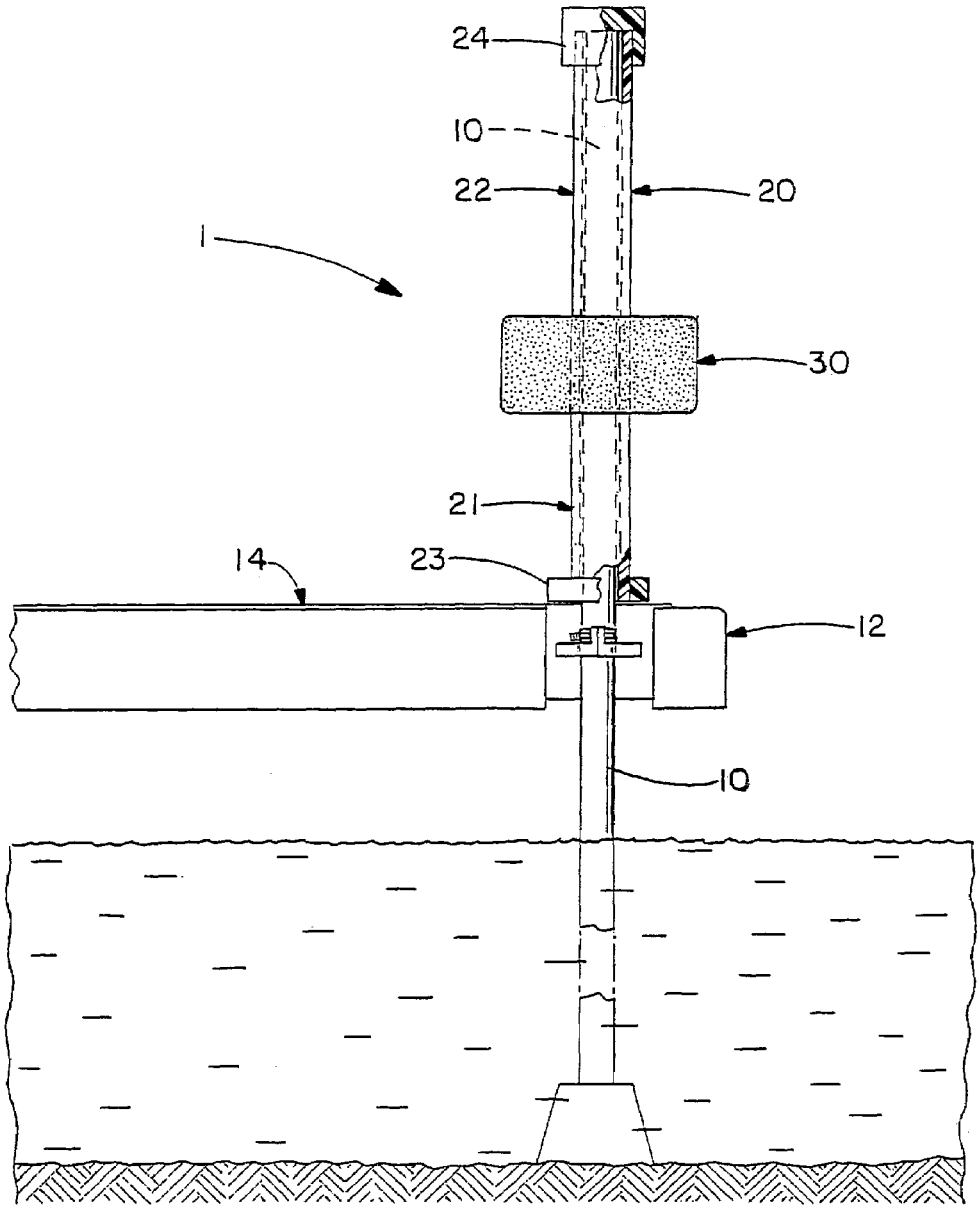
FIG. 1 is a side elevation view, in partial cross-section, of a floatable dock mooring article according to the present invention.

Referring to FIG. 1, a watercraft dock pipe 10 supports, in any conventional manner, dock 12 located above a body of water such as a lake, a river, a bay, etc. As shown in FIG. 1, a portion of dock pipe 10 generally extends a distance above the dock and mooring ropes, etc., have been connected thereto to retain a watercraft. Watercraft generally includes boats, canoes, jet skis, rafts, and the like.

Floating dock mooring article 1 is designed to be placed over and about dock pipe 10 which extends above dock 12. Mooring article 1 comprises various types of mooring members 20 such as pipes, tubes, ducts, and the like with the requirement that they are generally in the form of an annulus having an inside diameter and an outside diameter spaced apart therefrom. While the shape of the annulus is generally circular, it is to be understood that any shape can be utilized, such as elliptical, egg-shaped, pear-shaped, square tubing, and the like. Mooring member 20 can be made out of any suitable material such as lightweight metal, e.g. aluminum or titanium, but desirably has a specific gravity of less than 1.0. Suitable materials include various types of wood, plastic, fiberglass, composites, and the like with plastic generally being preferred. Plastics include polyvinyl chloride, polyester, polystyrene, nylon, various polyolefins such as polyethylene or polypropylene, and the like with polyvinyl chloride being preferred.

Mooring member 20 naturally has an inside diameter which is greater than the outside diameter of dock pipe 10 so mooring member 20 can easily be inserted thereover and freely rotate and/or elevate thereabout. Generally mooring member 20 has a lower flange 23 which contacts dock floor 14 and permits the member to rest thereon. Upper flange 24 is generally located at the upper vertical end portion of the pipe and preferably at the very end thereof. Flanges 23 and 24 can be attached, secured, etc. in any manner, as by screws, bolts, and more desirably is adhered by an adhesive such as styrene, epoxy, or acrylate and the like. The length of mooring member 20 can vary as from about a foot to any desired length such as about 10 or 12 feet with generally from about 2 to about 6 or about 8 feet desired. Naturally, the mooring member can be cut to any desirable length to compensate for a rise in the level of a body of water.

An important aspect of the present invention is the utilization of a flotation device 30 attached to mooring member 20 at any desired location. The float is made of a material which is lighter than and preferably substantially lighter than water and can be wood, plastic, foam, composite materials and the like. Float 30 can be rigid, semi-rigid, resilient or semi-resilient, or flexible. If the foam is made from a polymer, it can be closed-cell, or if an open cell structure preferably contains a continuous layer of a skin thereon to prevent water from entering. Suitable flotation devices 30 include various foams of polyurethane, polystyrene and the like. As with the flanges, flotation device 30 can be applied or secured to mooring member 20 in any conventional manner as through the use of flanges located on the top and bottom of the float and secured to the mooring member, but preferably is secured to the mooring member through the use of an adhesive such as styrene, epoxy, or acrylate, and the like.

Figure 3:
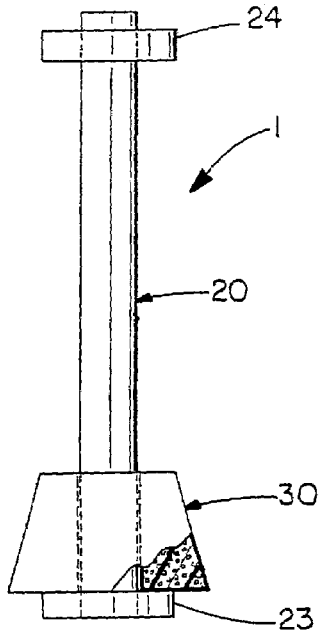
FIG. 3 is a partial side elevation view of another embodiment of the present invention showing only the floatable dock mooring article.

The shape of float 30 is generally not important so long as it has enough buoyancy so that when a rising water level of a lake, etc. contacts the float, it will raise up and cause mooring member 20 to float. While the float 30 is generally cylindrical as shown in FIG. 1, it can be in the form of a truncated frustum as shown in FIG. 3, wafer shaped, ball-shaped, and the like.

Figure 2:
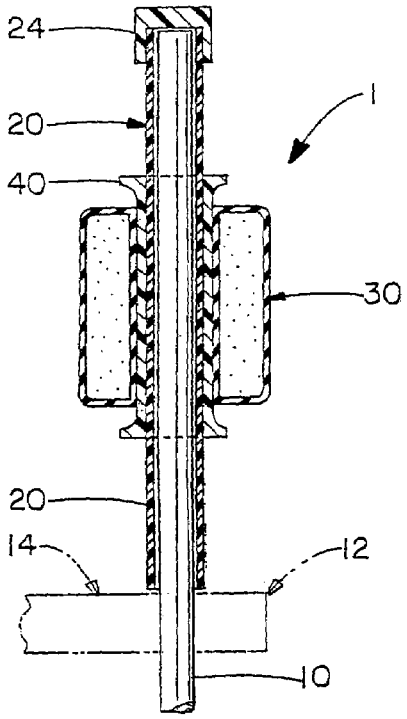
FIG. 2 is a side elevation view, in cross-section, of another floatable dock mooring article containing an inflatable float.

Another type of flotation device shown in FIG. 2 is an inflatable device made out of rubber or some other strong flexible material such as plastic and filled with a fluid, preferably air.

Regardless of the size, shape or type of flotation device, it can also generally serve as a bumper guard as to protect the side of a boat from striking a dock and being damaged.

The float 30 can generally be located in any position on mooring member 20 but desirably the bottom portion of the mooring member is avoided in order to prevent damage to the float by contact with the dock and also to allow a mooring device e.g., a rope to be attached thereto. Similarly, the float is not located at the top portion of the mooring member so when desired a mooring device can be attached thereto. Desirably, the float is located from about 10% to about 90% and more desirably from about 20% to about 80% of the mooring member height. Naturally the height of the float is generally small in comparison to the height of the dock mooring member 20 and is from about 1 or about 2 inches to about 6, about 8, or about 10 inches or even about one foot. Regardless of where the float is attached or adhered to mooring member 20, the portion below float 30 is referred to as lower leg 21 whereas the portion above the float is referred to as upper leg 22.

A mooring device such as a rope secures the watercraft to dock mooring member 20 which in turn freely rotates and/or elevates about dock pipe 10. In use, as the water level rises as in a flood, the water will generally contact float 30 and cause the mooring member to rise. Thus, the mooring device such as a rope will also rise and generally maintain an even relationship with the watercraft and thus does not cause it to tip and/or sink. If the rope is secured to upper leg 22, upper flange 24 prevents the rope from coming off the upper end of mooring member 20. Alternatively, if the rope is attached to lower leg 21, lower flange 23 will prevent the rope from being disengaged from mooring member 20. In order to gain an additional height advantage, float 30 is desirably located in an intermediate vertical portion of mooring member 20 or can be located near the top portion of a mooring member. The higher location provides an additional safety factor in that the water level must rise the additional distance to the upper float location before the pipe will commence rising up along dock pipe 10. For example, if flotation device 30 is located three feet above lower flange 23 or the bottom of mooring member 20, the water level must rise an additional three feet before it contacts flotation device 30 whereupon mooring member 20 commences rising. It should thus be apparent that floatable member article 1 of the present invention can accommodate large rises in the water level of a lake, river, etc.

Another embodiment of the invention relates to floatation device 30, which is not secured to mooring member 20, but rather freely slides up and down the mooring member. Such a floatation device can simply have an internal diameter which is larger than the external diameter of mooring member 20, but smaller than the outer diameter of flange 24 as in FIG. 3. Alternatively float 30 can be secured to sleeve 40 (see FIG. 2) preferably made out of light-weight material such as a composite or plastic as in the form of a cylinder. While the entire outer portion of the sleeve could have the same radius, desirably the upper and lower portions of the sleeve have projections or flanges so that a rope, etc., can be secured thereabout. Since sleeve-floatation device 40 freely rotates and/or elevates about mooring member 20, it will normally reside on dock floor 14. However, upon a rising water level, the sleeve—flotation device will rise upwardly on dock pipe 10 until the top portion of the sleeve contacts upper flange 24 at which time mooring member 20 will commence rising.

Figure 4:
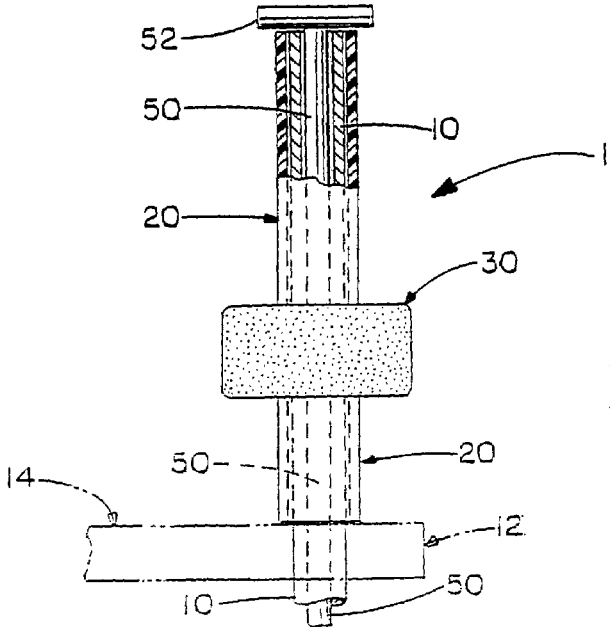
FIG. 4 is a side elevation view, in partial cross-section, of the floatable dock mooring article having an extension pipe.

Another embodiment of the present invention is shown in FIG. 4. which allows an even further rise in the height of dock mooring article 1. Mooring member 20 can be any of the various arrangements as shown in FIG. 1, 2, or 3. An extension pipe 50 generally having a hollow or solid cylindrical shape is inserted or resides inside dock pipe 10 which has an internal opening therein. The extension pipe can be made of the same types of materials as set forth above with respect to dock mooring member 20 such as lightweight metal, but preferably is plastic. The top of extension pipe 50 has flange 52 secured thereto and the same can be in the form of any shape such as a disk or a handle as shown in FIG. 4. However, extension pipe 50 is desirably longer than the length of mooring member 20 which resides on dock 12. That is, the extension pipe in being located within the dock pipe can extend several feet beneath the dock. Thus, as the water level rises and contacts float 30 and causes the same to raise, dock mooring member 20 will contact top flange 52 of the extension pipe and cause the extension pipe to rise. Even though the bottom end of dock mooring member 20 can rise above the top dock pipe 10, extension pipe 50 can still be located within the dock pipe, thereby maintaining a secure engagement of the watercraft.

In view of the above description, it should be apparent that floating dock mooring article 1 of the present invention is very versatile. For example, flotation device 30 can be located in any position along the length of dock mooring member 20 provided that a mooring line can be located either above or below the float. Multiple flotation devices can be utilized although a single float is generally preferred. The length of dock mooring member 20 can be long or short and optionally, can be utilized in association with extension pipe 50 to further extend the vertical range of usefulness of the dock mooring member. Moreover, couplings can be utilized to join one portion of mooring member 20 to another portion and/or to enlarge or reduce the diametrical size thereof.

Another embodiment of the present invention relates to the mooring member and the float having projections on generally the vertical sides thereof so that depending upon the location of the projections with respect to one another, mechanical engagement of the float with the mooring member can be at a predetermined height, or the float will be free to rise to a vertical height until it engages the mooring member projection that will cause the mooring member to rise up along the dock pipe. Thus, the float, for various reasons including safety and freedom to walk along the dock floor can be maintained above the dock floor. Alternatively, upon an increase in the water level such that when the water contacts the float, the float will rise and engage the mooring member projection and raise the mooring member up along the dock pole and thus extend the overall height at which the mooring member is secured to the dock pipe.

Figure 5:
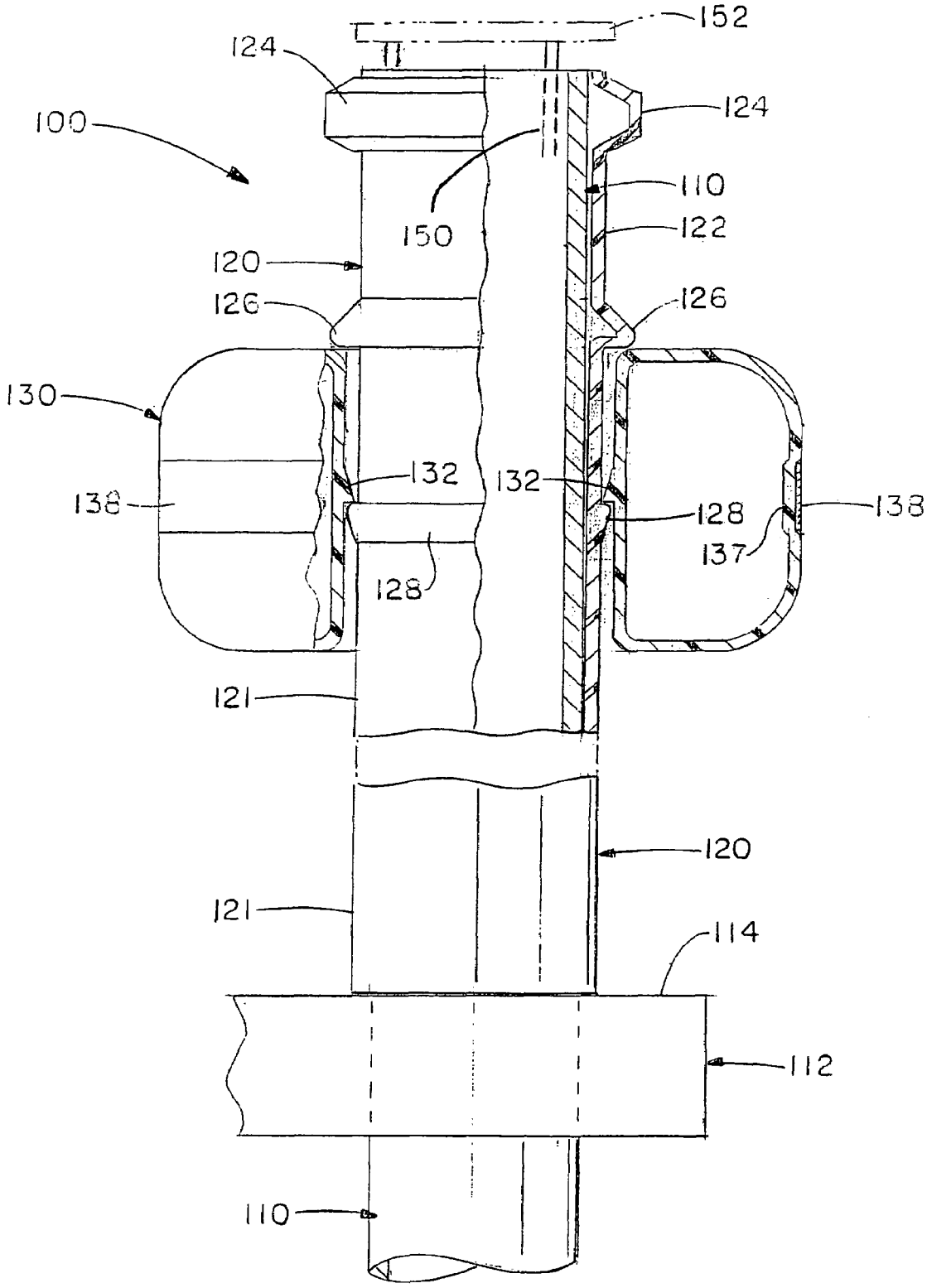
FIG. 5 is a side elevation view, in partial cross-section, of another embodiment of the floatable dock mooring article having a set projection on the mooring member.

An embodiment of the preceding paragraph is shown in FIG. 5 wherein the floatable dock mooring article is generally indicated by the numeral 100 and comprising dock pipe 110 that extends through or is connected to dock 112 and preferably floor 114 thereof. As with the previously described embodiments, mooring member 120 is connected to and preferably fits and slides over dock pipe 110 and generally freely rotates thereabout. The bottom of mooring member 120 resides upon a portion of a dock, such as dock floor 114. Mooring member 120 has lower leg 121 and upper leg 122 generally indicated as being respectively below or above mooring member set projection 128. As with the above embodiments set forth herein, mooring member 120 generally contains upper flange 124 at the upper end portion thereof. The flange through a securing medium such as a rope serves to retain a watercraft connected to the mooring member.

In order to maintain floats 30 such as shown in FIGS. 2 and 3, or float 130 such as shown in FIG. 5 at a predetermined (set) vertical or height location with respect to mooring member 120, the mooring member has a radially outward set projection 128 that has an external diameter and is located at a predetermined vertical distance or height on the mooring member. Radially outward set projection 128 is essentially a lateral extension of the mooring member and can be a ridge, a rim, a ring, a bulge, a protrusion, a ledge, and the like that can be square, rounded, angular, etc. shaped. Radially outward set projection 128 can be continuous and thus extend entirely (that is 360°) about the entire mooring member or it can be discontinuous extending for any desired arc of a circle and one or a plurality of such outward set projections can exist. The outward distance of projection 128 is such that it can engage a radially inward projection 132 of float 130 and either retain the float in a set position (that is at a predetermined fixed height) or be raised by the float from under the set projection so that upon contact with the underside of the projection the float will cause the mooring member to rise.

Figure 9:
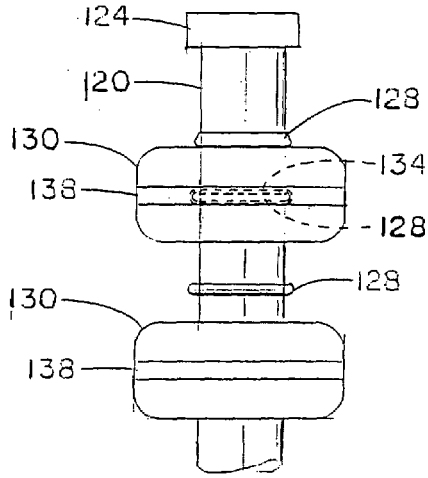
FIG. 9 is a side elevation view, in cross-section, of a further embodiment of a mooring member.

In one embodiment, such as shown in FIG. 9, mooring member includes two or more outward set projections 128 located at different vertical or axial heights, located at any desired distance from each other. Multiple outward set projections 128 allow connection of multiple floats 130 to the mooring member to provide greater ability of flotation. The use of multiple floats also provides a larger surface area that can serve as a fender and prevent a boat or other object from striking the dock.

Float 130 has a radially inward projection 132 located on a generally vertical inner side surface of the float that extends laterally inward thereof. The generally vertical side surface of float 30 has a diameter which is greater than the external diameter of mooring member outward set projections 128 so that the float is free to rise upward or downward along mooring member 120. Radially inward projections 132 can be defined in the same manner as with respect to outward set projections 128 and thus can be ridge, a rim, a ring, a bulge, a protrusion, a ledge, and the like that can be square, rounded, angular, etc. shaped and furthermore can be continuous such that it extends a full 360° about float 130 or can be discontinuous and of any arcual length and can be one or a plurality of such inward projections. The shape of the radially inward projection is preferably complementary to the outward set projection in one embodiment. In one embodiment, the design of the mooring member 120 and float 130 allow the same to snap together, in some cases making separation difficult or impossible without destroying the functionality of the mooring article, depending on the configuration of the set projections utilized.

In a preferred embodiment of the present invention, the mooring member radially outward set projection diameter is greater than the float radially inward projection internal diameter so that mooring member outward set projection 128 can engage float inward projection 132. In the embodiment as shown in FIG. 5, float projection 132 is located above mooring member set projection 128 and thus the height of float 130 is set at a predetermined distance above the bottom of mooring member 120 which generally resides upon floor 114 of dock 112. As the level of water rises it will contact float 130 and cause the same to rise about mooring member 120. Float 130 can rise until it contacts upper flange 124 at which point it will cause mooring member 120 to rise along dock pipe 110. Optionally, retention flange 126 can exist on upper leg 122 of the mooring member at a position between the top of float 130 but below upper flange 124. In this embodiment, float 130 will rise until it contacts retention flange 126 at which time it will cause the mooring member to rise. In another embodiment, when retention flange 126 is set at a location such that it contacts the top of float 130 when inward projection 132 resides upon outward set projection 128, the float will be locked into position. In this embodiment, as the water level contacts float 130 contained by the retention flange, the float will immediately cause mooring member 126 to rise. Thus, depending upon the location of optional retention flange 126 or mooring member upper flange 124, the effective extension height of mooring member 120 can be predetermined so that the mooring member serves as an additional height securement of a rope or the like to a watercraft.

Figure 6A:
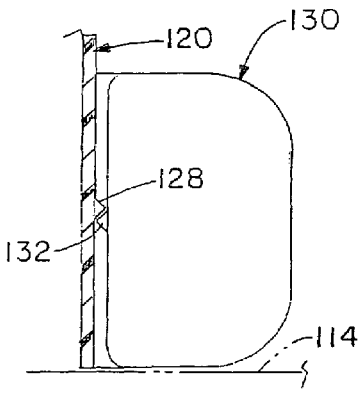
FIG. 6*a* is a limited cross-section view of another embodiment of FIG. 5 wherein the float radially inward projection is located below the mooring member radially outward set projection.

FIG. 6*a* represents a partial cross-sectional view of mooring member and float as set forth in FIG. 5 but wherein said float inward projection is located below mooring member outward set projection 128. In this embodiment, float 130 can reside upon dock floor 114. Upon a rise of the water level, float 130 will freely slide and rise up along mooring member 120 until float inward projection 132 contacts the bottom of mooring member outward set projection 128 at which point the float will cause mooring member 122 to rise.

The embodiment of FIG. 6*a* is desirable for situations wherein the float 130 can also be utilized as a dock bumper guard with regard to the watercraft vehicle.

Figure 6B:
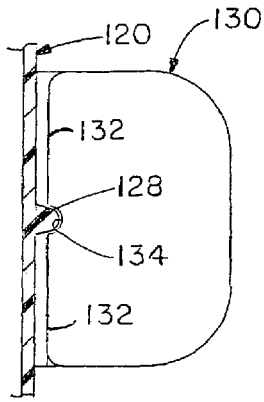
FIG. 6*b* is a limited cross-section view of another embodiment of FIG. 5 wherein the float has a radially inward recess that is capable of engaging the mooring member radially outward set projection.

The embodiment of FIG. 6*b* is similar to that of FIG. 5 except that float 30 instead of having a radially inward projection, has a radially outward recess 134 that engages (as by a snap fit) outward set projection 128. However, the float of FIG. 6*b* still has a vertical side inward portion located above and below mooring member outward set projection 128 and thus can be considered as having two radially inward float projections 132. In this embodiment, float 130 is fixed at a predetermined height, is not free to rise above mooring member set projection 128 as in the embodiment of FIG. 5, and also cannot fall below the set projection as in the embodiment of FIG. 6*a*. In this embodiment once a rising water level contacts float 130 it will immediately cause mooring member 120 to rise.

Figure 6C:
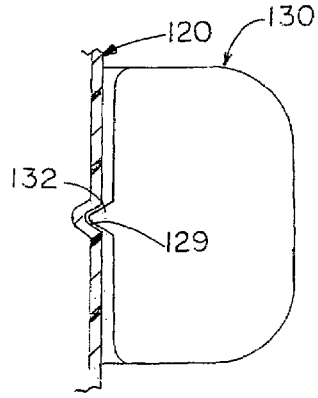
FIG. 6*c* is a limited cross-section view of another embodiment of FIG. 5 wherein the radially outward float projection is capable of engaging a radially inward mooring member set recess.

The embodiment of FIG. 6*c* is similar to that of FIG. 6*b* except that the float has a radially inward projection 132 and unlike the embodiments of FIG. 5, 6*a* and 6*b*, mooring member 120 has a radially inward recess 129. In order to apply float 130 to the mooring member, it must be slid up along the bottom leg of the mooring member until inward projection 132 resides within mooring member recess 129. A frictional engagement of a float thus exists with the mooring member as it is slid up lower leg and generally snaps into recess 129. The float inward projection thus must be made of a resilient or flexible material while the remaining portion of the float can also be made with such material or desirably of a more rigid material. The operation of the embodiment of FIG. 6*c* is similar to that of the embodiment of FIG. 6*b* in that the float is set at a predetermined height along the length of the mooring member and the dock flooring. As the water level rises, upon contact with float 130 it will cause mooring member 120 to rise.

Both embodiments of FIGS. 6*b* and 6*c* can contain the optional retention flange 126 at any location above the float but below upper flange 124.

The materials of the embodiments of FIGS. 5, 6*a*, 6*b*, and 6*c* are generally the same as set forth hereinabove and thus are fully incorporated by reference. By way of brief summary, mooring member 128 is preferably made of plastic such as polyvinyl chloride or polyolefin with polyethylene, and especially high density polyethylene being preferred. With respect to the float, it can be rigid, semi-rigid, resilient, or flexible. The float can contain various foams therein such as polyurethane or polystyrene or the float can simply be a layer of plastic containing air therein, e.g. a hollow float, with the plastic preferably being polyvinyl chloride or low density polyethylene.

The embodiments of FIG. 5, 6*a*, 6*b* and 6*c* can optionally further incorporate an extension pipe 150 shown in FIG. 4 generally having a hollow or solid cylindrical shaft which is inserted into and resides within dock pipe 110. The top of extension pipe 150 has flange 152 secure thereto and the same can be in the form of a handle, a cylindrical horizontal rod, a horizontal disc, and the like. As noted above, an important advantage of extension pipe 150 is that is it desirably longer in length than mooring member 120 and extends in dock pipe below the dock floor or below an average water level, or even can extend down to the bottom of a body of water in which the dock pipe resides. Thus, as the water level rises and contacts float 130 and causes mooring member to rise, extension pipe 150 will also rise. However, once the bottom of mooring member 120 is above the top of the dock pipe, the extension pipe will still be inserted within the dock pipe and provide still greater extension height to secure a watercraft to the mooring member. As set forth above, extension pipe 150 can be made of materials such as light weight metal, wood, etc., but preferably is plastic.

Figure 7:
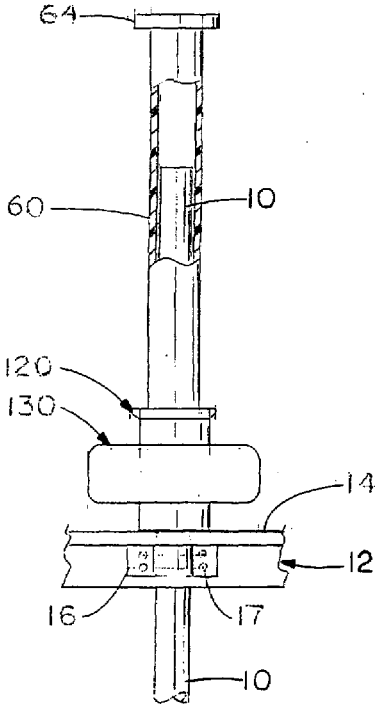
FIG. 7 is a side elevation view, in partial cross-section, of one embodiment of a floatable dock mooring article according to the present invention.

In yet a further embodiment of the present invention, a kit or assembly is provided including various components that, when assembled, form a floatable dock mooring article 1. As shown in FIG. 7, the assembly includes a dock pipe 10, such as described hereinabove. The dock pipe 10 can be any length, and generally has a portion that extends about 2 to about 6 feet, and preferably from about 3 to about 5 feet above the surface of the floor 14 of dock 12. The dock pipe 10 is connected to dock 12 through a suitable bracket or clamp 16, preferably via one or more fasteners 17. Dock pipe 10 may or may not provide any support for dock 12 and may only be used in conjunction with the float dock mooring article in some embodiments.

Extension pole 60 is connected to dock pole 10 and generally has an inner diameter greater than the outer diameter of dock pole 10 and fits over and around dock pole 10. Extension pole 60 is either movably or fixedly connected to dock pole 10 in order to provide a desired form or action to the floatable dock mooring article. When movably connected, extension pole 60 is movable in a direction parallel to a longitudinal axis of the dock pole 10, i.e. in a substantially vertical direction as shown in FIG. 7. Extension pole 60 includes an upper flange 64 similar to upper flange 24 and having an outer diameter greater than a minimum inner diameter of the mooring member 120 in order to prevent mooring member 120 from becoming displaced from the assembly at an extremely high water level, such as above the upper end of extension pole 60. Extension pole 60 has a lower end generally disposed against a portion of the dock 12 such as dock floor 14 or a portion of bracket 16. Extension pole 60 has a length generally from about 2 to about 6 feet, preferably from about 3 to about 5 feet. Mooring member 120 is formed as described hereinabove generally including one or more floats 130 as described herein. As is also described hereinabove, a rope or other object can be connected to mooring member 120 and is allowed to rise along with mooring member 120 as a water level rises. Float 130 can act as a protector or bumper guard and also serve to prevent a boat or watercraft from contacting the dock 12.

Figure 8:
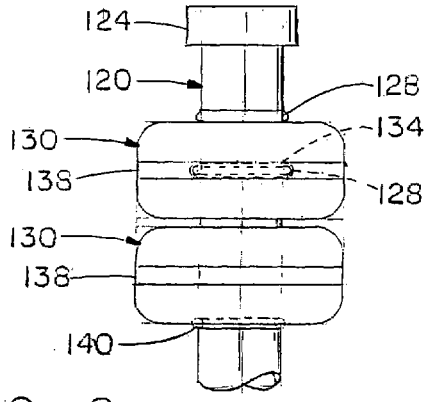
FIG. 8 is a side elevation view, in cross-section, of one embodiment of a mooring member.

In yet a further embodiment of the present invention, as illustrated in FIG. 8, the mooring member 120 can include a plurality of floats 130. Generally any number of floats 130 can be utilized, such as about 2 to about 6, and preferably 2 to about 4. Each float 130 can be located at a different location along the longitudinal length of mooring member 120 as desired and can be connected to mooring member 120 in any suitable arrangement, i.e. movably or fixedly such as described hereinabove. Alternatively, the float 130 can be positioned as shown in FIG. 8 utilizing a movable float stop 140 such as an o-ring, clamp or the like. Moveable float stop 140 can be configured such as an elastomeric or other ring that attaches to a portion of the mooring member with a pressure fit, such as a rubber band, or can be a mechanical device such as a tube or hose clamp, etc. Movable stop 140 is removably connected to mooring member 120 at a location thereon, and is preferably fixedly connected, such as by pressure or elasticity at a desired location on mooring member 120. Two or more movable stops 140 can be utilized to position a float when mooring member 120 does not contain a projection, such as projection 128 or flange 126.

In a further embodiment of the present invention, as illustrated in FIG. 9, mooring member 120 is provided with at least one float 130 fixedly connected thereto (upper float) and at least one float movable in relation to mooring member 120 (lower float). The presence of two or more floats generally provides additional buoyancy to the mooring member 120.

A float 30 or 130, such as illustrated in FIGS. 5 and 9, are provided with a float band recess 137 and a band 138, in a further embodiment of the present invention. Band recess 137 preferably extends around the float outer circumference and can have any depth. Recess 137 depth generally depends on factors such as the type and/or thickness of band 138 utilized and is typically sufficient to maintain band 138 therein. The axial or height of the recess, measured along the mooring member longitudinal axis, can vary based on the size of the flat and ranges generally from about 0.25 to about 2.0 inches, desirably from about 0.50 to about 1.5 inches, and is preferably about 0.75 to about 1.25 inches.

Band 138 in one embodiment is a polymeric material such as vinyl, and preferably has a sufficient elasticity in order to be fitted on the float and positioned in recess 137. Band 138 has a height which is the same as or is slightly less than the ranges set forth above for recess 137. In one embodiment, the band 138 is formed from a strip of material wherein the end portions have been heat sealed together. Band 138 can be any color and can be color coordinated or contrasting to blend or match the color of the float, boat cover, boat color. Band 138 is reflective in one embodiment to make a dock more visible, such as at night. The band 138 is preferably continuous, but can be discontinuous and can be secured to a float such as in recess 137 with a suitable adhesive. Band 138 can be embossed, hot stamped or silk screened to include identifying indicia such as letters, words, numbers, symbols, slogans, or the like, and combinations thereof.

While in accordance with the Patent Statutes, the best mode and preferred embodiments have been set forth, the scope of the invention is not limited thereto, but rather by the scope of the attached claims.

What is claimed is:

1. A floatable dock mooring article, comprising:

a mooring member having at least one radially outward set projection, said at least one radially outward set projection having an external diameter;

said mooring member adapted to have an internal diameter greater than the outer diameter of a dock pipe and being capable of contacting and resting on a portion of a dock, said mooring member adapted to be movably connected to a portion of said dock pipe;

a flange, said flange located at the top portion of said mooring member; and a float operatively connected to said mooring member, said float having at least one radially inward projection having an internal diameter, said mooring member outward set projection external diameter being greater than said float inward projection internal diameter, and said mooring member set projection being capable of engaging said float inward projection.

2. The floatable dock mooring article according to claim 1, wherein said float inward projection is located below said mooring member outward set projection, and said float is capable of being moved between a bottom of said mooring member and said mooring member set projection.

3. The floatable dock mooring article according to claim 2, including a float retention flange, said retention flange located below said mooring member flange and above said mooring member outward set projection.

4. The floatable dock mooring article according to claim 1, wherein said float inward projection is located above said mooring member outward set projection, and said float is capable of being moved between said mooring member set projection and said mooring member upper flange.

5. The floatable dock mooring article according to claim 4, including a float retention flange, said retention flange located below said mooring member flange and above said mooring member outward set projection.

6. The floatable dock mooring article according to claim 1, wherein said float has at least two of said radially inward projections and a radially outward recess therebetween, and wherein said radially outward recess engages said mooring member set projection so that upon upward movement of said float, said mooring member is moved therewith.

7. The floatable dock mooring article according to claim 1, wherein the article further includes an extension pole having an internal diameter greater than the outer diameter of the dock pipe, and wherein the mooring member has internal diameter greater than an outer diameter of the extension pole and is movably connected to the extension pole.

8. The floatable dock mooring article according to claim 1, including an additional float operatively connected to the mooring member.

9. The floatable dock mooring article according to claim 1, wherein the article further includes a movable stop capable of connecting the float to the mooring member at a desired location thereon.

10. The floatable dock mooring article according to claim 1, wherein the mooring member includes at least two radially outward set projections located at different heights on the mooring member.

11. The floatable dock mooring article according to claim 1, wherein the float includes a band recess extending around an outer surface of the float and a band located in the recess.

12. The floatable dock mooring article according to claim 11, wherein said band is colored.

13. A floatable dock mooring article, comprising:

a mooring member having at least one radially inward recess, said mooring member adapted to have a minimum internal diameter greater than the outer diameter of a dock pipe and being capable of contacting and resting on a portion of a dock, said mooring member adapted to be movably connected to a portion of said dock pipe;

a flange, said flange located at the top portion of said mooring member;

a float operatively connected to said mooring member, said float having at least one radially inward projection and wherein said float radially inward projection engages said mooring member radially inward recess so that upon upward movement of said float, said mooring member is moved therewith.

14. The floatable dock mooring article according to claim 13, including a float retention flange, said float retention flange located below said mooring member flange and above said mooring member radially inward recess.

15. The floatable dock mooring article according to claim 13, wherein the article further includes an extension pole having an internal diameter greater than the outer diameter of the dock pipe and wherein the mooring member has internal diameter greater than an outer diameter of the extension pole and is movably connected to the extension pole.

16. The floatable dock mooring article according to claim 13, including an additional float operatively connected to the mooring member.

17. The floatable dock mooring article according to claim 13, wherein the float includes a band recess extending around an outer surface of the float and a band located in the recess.

18. The floatable dock mooring article according to claim 17, wherein said band is reflective.

19. A floatable dock mooring article, comprising:

a mooring member having a radially outward set projection, said mooring member adapted to have a minimum internal diameter greater than the outer diameter of a dock pipe and being capable of contacting and resting on a portion of a dock, said mooring member adapted to be movably connected to a portion of said dock pipe;

a flange, said flange located at the top portion of said mooring member;

a float operatively connected to said mooring member, said float having at least one radially outward recess wherein said mooring member radially outward set projection being capable of engaging said float outward recess so that upon upward movement of said float, said mooring member is moved therewith.

20. The floatable dock mooring article according to claim 19, including a float retention flange, said retention flange located below said mooring member flange and above said mooring member radially outward set projection.

21. The floatable dock mooring article according to claim 19, wherein the article further includes an extension pole having an internal diameter greater than the outer diameter of the dock pipe and wherein the mooring member has internal diameter greater than an outer diameter of the extension pole and is movably connected to the extension pole.

22. The floatable dock mooring article according to claim 21, including an additional float operatively connected to the mooring member.

23. The floatable dock mooring article according to claim 19, wherein the mooring article includes at least two radially outward set projections located at different heights on the mooring member.

24. The floatable dock mooring article according to claim 19, wherein the float includes a band recess extending around an outer surface of the float and a band located in the recess.

25. The floatable dock mooring article according to claim 24, wherein said band is colored.

26. The floatable dock mooring article according to claim 24, wherein said band is reflective.

* * * * *